United States Patent [19]

Anderson

[11] 4,357,890

[45] Nov. 9, 1982

[54] STABILIZED, VARIABLE BUOYANCY APPARATUS

[76] Inventor: Douglas E. Anderson, Horley, Surrey, RH6 8DH, England

[21] Appl. No.: 249,437

[22] Filed: Mar. 31, 1981

Related U.S. Application Data

[60] Division of Ser. No. 82,153, Oct. 5, 1979, Pat. No. 4,276,846, which is a continuation of Ser. No. 850,047, Nov. 9, 1977, abandoned.

[51] Int. Cl.[3] ..... B63B 43/14

[52] U.S. Cl. ..... 114/123; 114/125

[58] Field of Search ..... 114/122, 123, 125, 61, 114/44, 45, 49, 52, 50, 51, 46, 53

[56] References Cited

U.S. PATENT DOCUMENTS

| | | | |
|---|---|---|---|
| 990,759 | 4/1911 | Maggio | 114/123 |
| 1,417,824 | 5/1922 | Haack | 114/123 |
| 2,472,295 | 6/1949 | Harris | 114/45 |
| 3,415,212 | 12/1968 | Hennig | 114/45 |

FOREIGN PATENT DOCUMENTS

| | | | |
|---|---|---|---|
| 197779 | 5/1923 | United Kingdom | 114/46 |

*Primary Examiner*—Sherman D. Basinger

*Attorney, Agent, or Firm*—Roylance, Abrams, Berdo & Farley

[57] ABSTRACT

An adjustable buoyancy apparatus comprises a frame and at least two floating members of variable buoyancy which are pivotally coupled to the frame for pivotable motion in a substantially vertical plane between horizontal positions and maximum elevated positions. In the maximum elevated positions, the angle between the longitudinal axes of the floatable members and the horizontal is less than 90 degrees and the floating members are inclined upwardly toward each other. Locking mechanisms hold the floatable members in the horizontal and maximum elevated positions. This floatable member arrangement compensates for the rolling tendencies of the apparatus and stabilizes the apparatus when the apparatus is partially or completely submerged.

8 Claims, 2 Drawing Figures

STABILIZED, VARIABLE BUOYANCY APPARATUS

This application is a division of U.S. patent application Ser. No. 82,153, filed Oct. 5, 1979 and entitled Recovery Apparatus, now U.S. Pat. No. 4,276,846; which application was a continuation of U.S. patent application Ser. No. 850,047, filed Nov. 9, 1977, now abandoned.

BACKGROUND OF THE INVENTION

This invention relates to variable buoyancy apparatus having improved stability against rolling. The invention may be applied to rigs for use in salvage but in its broadest aspect is simply concerned with adjusting the buoyancy and stability of any floating vessel or vessel immersed in a liquid by providing such vessel with novel floatable members of particular adjustable disposition with respect to the vessel.

U.S. Pat. No. 1,691,738 (Powell) describes an apparatus for use in recovering articles stranded in water or submerged articles or materials, which apparatus comprises particular pontoon structures the buoyancy of which can be varied and each of which have arms mounted thereon, all of the arms being connected to tong-like gripping members, the arms being connected by means of a pivot and being so arranged as to oppose the tong-like gripping members such that the buoyancy of the pontoons can can varied and the tong-like gripping members caused to come together in a tong-like action. Unfortunately, such structures, when in use without other guiding means, tend to be unstable and to exhibit excessive rolling and lack of control. Exact buoyancy control is necessary in these circumstances, and this can be a difficult matter to achieve practice. The Powell apparatus employs buoyed anchors connected to winches located on each end of each pontoon to guide the apparatus over the vessel to be recovered. These winches are controlled by an operator in a special chamber in the apparatus.

U.S. Pat. No. 2,280,547 (Scofield) discloses a device for raising sunken vessels using pivoting opposed units which include floats and which together provide a jaw-like action for salvage purposes. However, there is no suggestion of employing floatable members to compensate for rolling tendencies in the manner of this invention.

In the present invention, by contrast, by carefully positioning pivotable floatable members around an apparatus which is, in use, at least partially submerged, and enabling these members to pivot in a particular manner, a greatly enhanced degree of control is achieved and operations under water may be effected without undue rolling.

SUMMARY OF THE INVENTION

In accordance with the invention an apparatus may be provided with an adjustable buoyancy facility and stabilised against rolling tendencies by being provided with floatable, pivotable members. Such apparatus is provided with at least two floatable members, each of said members having a longitudinal axis and being of variable buoyancy, said at least two floatable members being pivotally connected to said apparatus so as to be capable of pivoting motion in a substantially vertical plane to a maximum angle of elevation wherein the angle between said longitudinal axis and the horizontal in said vertical plane is less than 90° and said pivotable floatable members being so arranged about said apparatus as to stabilize the same when it is at least partially submerged and said pivotable floatable members are elevated. Locking means is provided to hold each of the members at least in the horizontal and maximum elevated positions.

Preferably the present apparatus has four pivotable floatable members, arranged as opposed pairs. With this construction, the members of each pair can pivot upwardly in opposite directions, one pivoting clockwise and the other anti-clockwise. This arrangement provides the desired stability against rolling.

It has been found that the optimum angle of elevation of the pivotable floatable members is about 68°, this angle giving maximum stability.

For greatest stabilisation, the floatable members should preferably be of such a length when they are elevated at an angle of about 68° the ends thereof opposite the respective pivots project above the level of the remainder of the apparatus or vessel being stabilised.

Preferably, the present apparatus includes locking means for locking the floatable pivotable members in any desired position between maximum elevation and the horizontal position.

DESCRIPTION OF A PREFERRED EMBODIMENT

Apparatus in accordance with the present invention may be of any desired type where, in use, the apparatus is at least partially submerged. One preferred application of the invention is in the stabilisation of salvage rigs.

Figure 1:
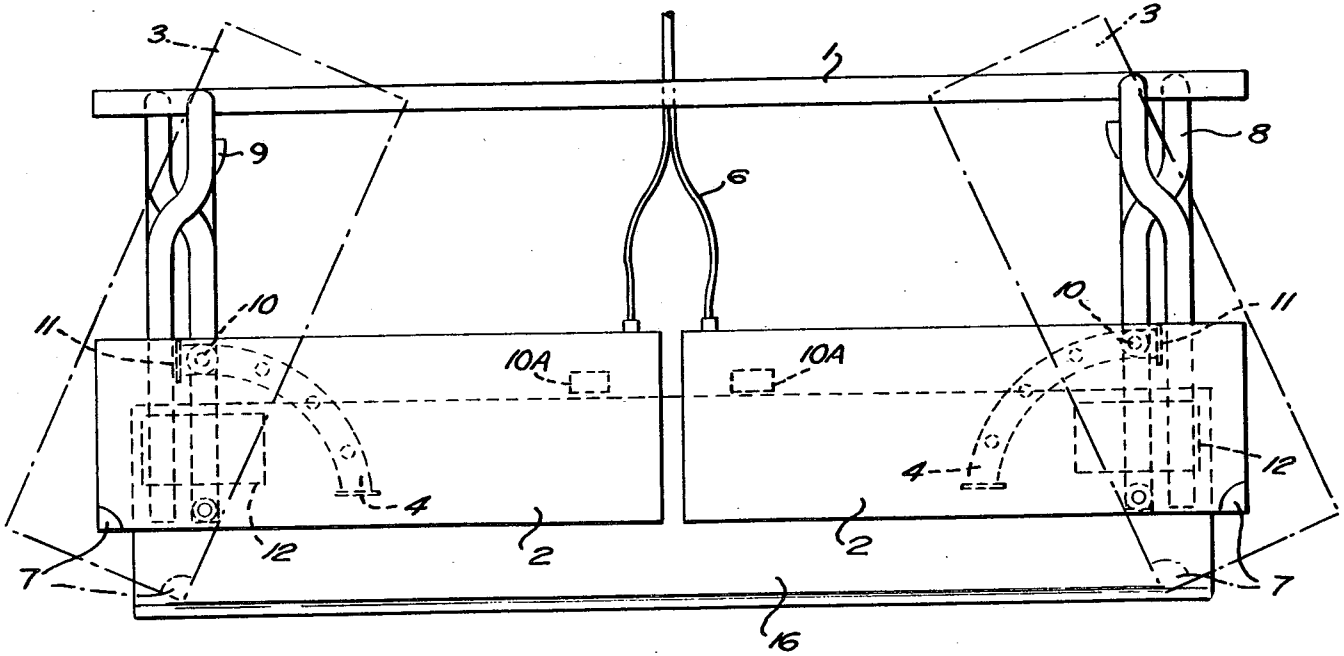
FIG. 1 shows a side view in diagrammatic form of a salvage rig employing pivotable floatable members in accordance with the invention.

Referring to FIG. 1, a salvage rig is shown wherein the rig main frame 8 comprises the arms which provide the caliper action of the apparatus. Frame 8 is held together by main spar 1. Spar 1 forms the pivot and is actually part of the side of frame 8 marked A in FIG. 2. Spar 1 thus joins together the two arms which constitute side A of frame 8. The two arms constituting side B (FIG. 2) of frame 8 are not integral with spar 1, unlike side A, but can pivot about spar 1 when locking means 9 is released. Buoyancy tanks 2 are provided on each side of the apparatus and are pivotable in opposite directions about axles 5 to a maximum elevation of 68°. The dotted lines outline areas 3 in FIG. 1 showing the tanks 2 in the raised position when they just reach to a higher level than spar 1. Locking quadrants 4 are provided to enable the tanks to be locked at various levels by means of locks 10. Locks 10A are provided to hold tanks 2 in a horizontal position for surface working of the rig. Stops 11 are provided at the ends of each quadrant 4 to prevent the tanks 2 from passing beyond horizontal or maximum elevated positions.

An airline 6 is provided as an air input and output for each tank 2 and tanks 2 each have an aperture 7 therein.

Clamping pads 12 are provided on each of the four arms (one for each tank 2) which constitute frame 8. In FIG. 1 it can be seen that an elongated dredging scoop 16 is provided running along the length of each side of the apparatus.

Figure 2:
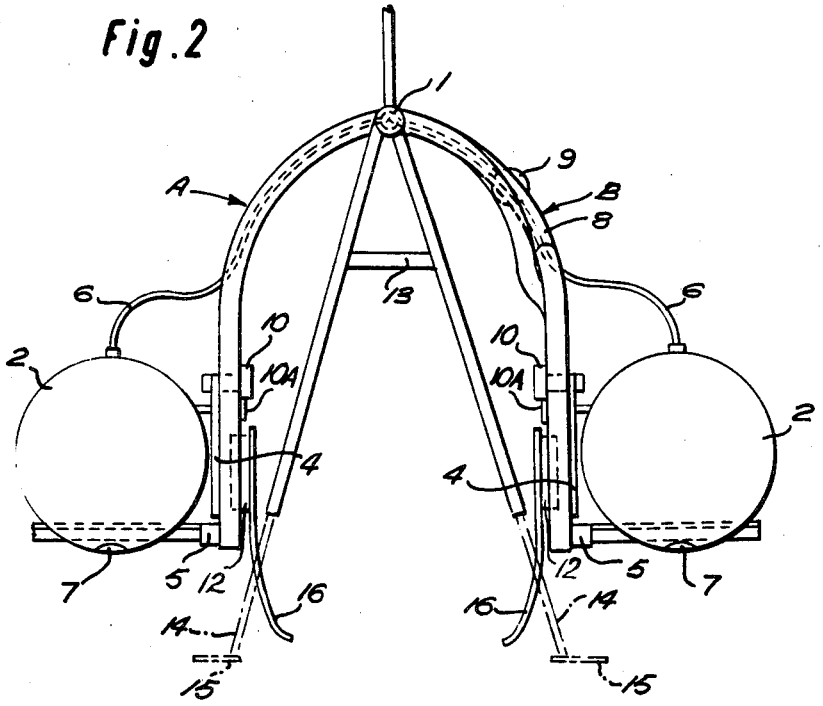
FIG. 2 shows an end-on view of the rig of FIG. 1 but including an "A"-frame.

In FIG. 2, an "A"-frame 13 can be seen attached to spar 1. There is in fact an "A"-frame 13 at each end of the spar 1 although only one such frame can be seen in the Figure. A single "A"-frame can be utilised in the centre of the apparatus as an alternative to one at each end, the frame being shaped to clear the material to the salvaged. Frame 13 has extendible legs 14 (dotted lines indicating the extension) which terminate in feet or sole plates 15.

In use, with tanks 2 initially full of air, as airline 6 is opened water is allowed to flood into tanks 2 through apertures 7 thus displacing air from tanks 2 out through airline 6. This causes the tanks 2 to pivot about axles 5 up to the maximum elevation of about 68° as locks 10 are released and the apparatus beings to sink. Of course, the tanks 2 can be locked at any intermediate elevation by the use of locks 10 and quadrants 4 if appropriate for the particular job in hand.

Airline 6 leads to a control board (not shown) and air can be voided to atmosphere through this system. When a valve (not shown) is closed on the control board air is prevented from escaping through airline 6 from tanks 2 and hence more water is prevented from entering tanks 2 through apertures 7. In this way the buoyancy of the tanks 2 can be adjusted and a controlled descent of the apparatus is achieved.

Once the apparatus has reached the bottom, air is allowed out though airlines 6 and flooded tanks 2 pivot back to the horizontal position where they can be locked by locks 10 and 10A. The downward movement of the tanks 2 is achieved under the influence of gravity but, if desired, motors can be incorporated to control both downward and upward pivoting of tanks 2.

When the apparatus is in position over the wreck for salvage, the locks 9 are released and air is pumped into tanks 2 via airline 6 expelling water through apertures 7. This causes the clamping pads 12 to come together and grip the wreck therebetween as the tanks 2 tend to move outwards as their buoyancy increases. Frame 8 thus acts in a caliper-like manner.

When the wreck has been gripped by pads 12 with sufficient pressure locks 9 are closed to hold the apparatus and wreck together and locks 10 and 10A are disengaged. Air is pumped into tanks 2 via airline 6 and this causes tanks 2 to pivot up to an elevated position where they are locked. Sufficient air can now be pumped into the tanks to cause the wreck and rig to rise to the surface. The ascent can of course be controlled by pumping in more air, or, if the ascent is too rapid, allowing air out through airline 6. In this manner the pressure in tanks 2 seldom varies from that outside them.

Once the apparatus reaches the surface all water is expelled from the tanks 2 and the airline 6 closed to prevent escape of air from tanks 2. The apparatus + wreck can now be driven or towed to the desired destination.

Airline 6 may be a common manifold airline to give a balanced flow to each tank 2 or may be a combination of individual airlines to give a greater degree of adjustment to the overall apparatus by supplying air to each tank 2 individually. Alternatively, a combination of common and individual airlines may be employed. The arrangement of valves employed at the control board varies, of course, with the type of airline 6 arrangement used.

If the apparatus has been used to bring the wreck or other salvage to the surface of the sea with tanks 2 raised, the wreck can be held higher in the water by allowing tanks 2 to pivot downwards to the horizontal position. This can be achieved by "beaching" the apparatus on a suitable beach and unlocking locks 10 permitting tanks 2 to return to the horizontal position under the influence of gravity at low tide. The tanks 2 can then be relocked in the horizontal position and the wreck + apparatus floated off at high tide. A series of beaching operations may be necessary to achieve the object of horizontal tanks 2.

It will be appreciated that the use of individual airlines 6 to each tank 2 permits complex manipulation of the position of the apparatus and the degree of roll which it adopts when submerged. Two or more rigs can be employed in the manner described to right submerged craft and salvage them, one salvage rig being used to roll and right the craft and then a second to hold the craft in an upright position while the first rig adjusts its position prior to the ascent.

An apparatus as shown in the drawings can be used for dredging, laying pipes or masonry, or gaining mineral aggregates from the sea bed etc. For such uses dredging scoops 16 are employed along with "A"-frames 13 at each end of main spar 1 (see FIG. 2). Recovery of the material from the sea bed etc is carried out by employing the apparatus with the extendible legs 14 retracted. The material can then be deposited at the desired location by allowing the apparatus to sink until the feet 15 on extended legs 14 touch bottom. With their buoyancy reduced tanks 2 will tend to sink inwards causing the caliper-like action of frame 8 to be reversed and scoops 16 to open thus depositing the required material. Legs 14 can be provided with motor-driven extensions or the extensions can then be retracted by unlocking them (the leg extensions 14 are provided with locking devices—not shown) and reducing the buoyancy of the apparatus causing the legs 14 to be retracted as the apparatus sinks with feet 15 resting on the bottom.

For very deep water working a ball valve arrangement (not shown) can be housed in each tank 2 to combat the expansion of air in tanks 2 as the outside pressure drops while the apparatus ascends from deep water. In this way the valve would check a too rapid ascent and assist in equilibrating pressure inside and outside tanks 2.

It will be appreciated that whereas the above description relates to a salvage rig, the principle of the invention, i.e. the use of pivotable floatable members to adjust buoyancy and provide stability against rolling, can be applied to any apparatus or vessel which is used afloat or submerged.

The skilled man will be able to envisage variations or modifications of the above-described embodiment, which embodiment is illustrative not limiting, and of the pivotable members of the invention, without departing from the spirit and scope of the invention defined in the appended claims.

What is claimed is:

1. An adjustable buoyancy apparatus having improved stability against rolling, comprising:

a frame;

at least two floatable members having longitudinal axes and having means for varying the buoyancy thereof;

coupling means, pivotally connecting said floatable members to said frame, for controlling pivoting motion of said floatable members in a substantially vertical plane between horizontal positions and maximum elevated positions, in said maximum elevated positions angles between said longitudinal axes and the horizontal are less than 90 degrees and said floatable members are inclined upwardly toward each other; and floatable member locking means for holding each of said floatable members at least in said horizontal and maximum elevated positions;

whereby said floatable members are arranged on said frame to compensate for rolling tendencies of the apparatus and to stabilize the apparatus when the apparatus is at least partially submerged.

2. Apparatus according to claim 1, wherein there are four of said pivotable floatable members, said members being arranged as opposed pairs.

3. Apparatus according to claim 1, wherein said floatable members are of a length such that when said members are elevated at an angle of about 68° said members project above the uppermost portion of the remainder of said apparatus.

4. Apparatus according to claim 1 including locking means for locking said pivotable floatable members in any desired position between said maximum elevated and horizontal positions.

5. An apparatus according to claim 1 wherein the angles between the horizontal and said floatable member longitudinal axes in said maximum elevated positions are about 68 degrees.

6. An apparatus according to claim 1 wherein said means for varying the buoyancy of said floatable members comprises means for flooding said floatable members and air pressure means for supplying air pressure to said floatable member and for venting air pressure therefrom.

7. An apparatus according to claim 6 wherein said coupling means and means for flooding each said floatable member are located adjacent one end thereof.

8. An apparatus according to claim 1 wherein said longitudinal axes of said floatable members are substantially colinear in said horizontal positions thereof, and said coupling means are located at remote ends of said floatable members.

* * * * *